US006302720B1

(12) United States Patent
Muller

(10) Patent No.: US 6,302,720 B1
(45) Date of Patent: Oct. 16, 2001

(54) ELECTRICAL PLUG CONNECTION, PARTICULARLY FOR MOTOR VEHICLE APPLICATIONS

(75) Inventor: Klaus Muller, Oberscheinfeld (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/544,085

(22) Filed: Apr. 6, 2000

(30) Foreign Application Priority Data

Apr. 9, 1999 (DE) ..... 199 16 074

(51) Int. Cl.[7] ..... H01R 13/625
(52) U.S. Cl. ..... 439/347; 439/157
(58) Field of Search ..... 439/157, 347, 439/310, 557, 158–160

(56) References Cited

U.S. PATENT DOCUMENTS 5,575,676 * 11/1996 Tsukakoshi et al. ..... 439/347
5,681,184 * 10/1997 Pamart et al. ..... 439/595
5,823,807 * 10/1998 Yamasaki et al. ..... 439/157
5,928,011 * 7/1999 Flask et al. ..... 439/157

FOREIGN PATENT DOCUMENTS

19530334 A1 2/1997 (DE) .
19756494 A1 7/1998 (DE) .

* cited by examiner

*Primary Examiner*—Brian Sircus
*Assistant Examiner*—Son V. Nguyen
(74) *Attorney, Agent, or Firm*—Perman & Green, LLP

(57) ABSTRACT

An electrical plug connection is provided having a plug housing and a complimentary contact housing. A transverse slide is slidably coupled to the contact housing between a closed position and an open position. The transverse slide locks the plug housing to the contact housing in the closed position. At least one movable carriage is slidably coupled to the contact housing. At least one spring element exerts a force between the movable carriage and the transverse slide during closing of the transverse slide. The spring element pushes the transverse slide to the open position when there is an incomplete closing of the transverse slide. The transverse slide is locked in the closed position only on complete closing of the transverse slide.

10 Claims, 6 Drawing Sheets

ELECTRICAL PLUG CONNECTION, PARTICULARLY FOR MOTOR VEHICLE APPLICATIONS

FIELD OF THE INVENTION

The invention relates to an electrical plug connection, particularly for motor vehicle applications, with a plug housing, a contact housing complementary to the plug housing and a transverse slide for locking the plug housing in the contact housing.

BACKGROUND OF THE INVENTION

Plug connections of this kind are mainly used in a wall of a housing in order to connect to external conductors electrical connections of a device in the housing. For example, plug connections of this kind are used for pre-cabling for motor vehicle transmissions. It is particularly in the area of motor vehicle transmissions that intense vibrations occur in addition to relatively high operating temperatures and may result in the plug connections loosening or breaking away.

To secure the connection, known plug connections have locking devices which are intended to ensure that the plug housing is secured in the contact housing. On assembly, of course, care must be taken to ensure that the locking device really is engaged. In practice it may happen that the fitter brings the locking device only into an intermediate position in which although the plug housing has been pushed into the contact housing the locking device is not in its catch position. In that case the plug connection may automatically break away due to the high vibrations occurring in the operation of the motor vehicle.

The object of the invention is to provide an electrical plug connection wherein assembly faults caused by incomplete closure or engagement of the locking device are reliably avoided.

This problem is solved by the features of claim 1.

SUMMARY OF THE INVENTION

The plug connection according to the invention comprises a plug housing, a contact housing complementary to the plug housing and a transverse slide for locking the plug housing in the contact housing. At least one spring element acts on at least one movable carriage, said spring element exerting an increasing stress on the slide during the closing of the latter and pushing it back into its open position in the event of an incomplete closing operation. The slide is locked in its closed position only on complete closure.

The co-operation of the slide, spring element and carriage according to the invention has the effect that the electrical plug connection and its locking device are always in a defined state and this state is unmistakably indicated to the fitter. If the slide is inserted only incompletely, coupling of the carriage to the slide by way of the spring element causes the latter to exert a force on the slide which, after the manual insertion force has ceased, automatically pushes it back into its open position. This indicates to the fitter that the locking device has not been engaged and hence cannot fulfil its securing function.

Another special feature of the invention is that on the insertion of the slide the two main parts of the plug connection, namely the plug housing fixed on a housing wall, and the contact housing, are clamped together, this being achieved by the configuration of guides in the slide to receive studs on the plug housing.

This leads to the advantageous possibility of making the connection between electrical contacts of the plug part and the electrical contacts of the contact part only when the slide is inserted. If the housings are simply plugged together (plug housing, contact housing) and the slide is in the open position, there is no electrical connection between the contacts. Because of the restoring force of the spring element the slide occupies two defined positions, namely the open position and the closed position. The configuration of the guide groove has the effect that the two housings are guided together on insertion of the slide and are separated on the rise of the slide. Similarly, the electrical contacts of the main parts are brought into electrical connection on the insertion and separated from one another on the rise of the slide. There is consequently a direct relationship between the position of the slide and the electrical connection of the corresponding electrical contacts. Thus in the closed position the contacts are interconnected while in the open position they are not. If current now flows through the plug connection, that simultaneously confirms that the slide is completely closed.

Preferred embodiments of the invention are indicated in the sub-claims.

BRIEF DESCRIPTION OF THE DRAWINGS

One preferred exemplified embodiment of the plug connection according to the invention is described below in detail with reference to the drawing, wherein.

DETAILED DESCRIPTION OF THE INVENTION

Figure 1:
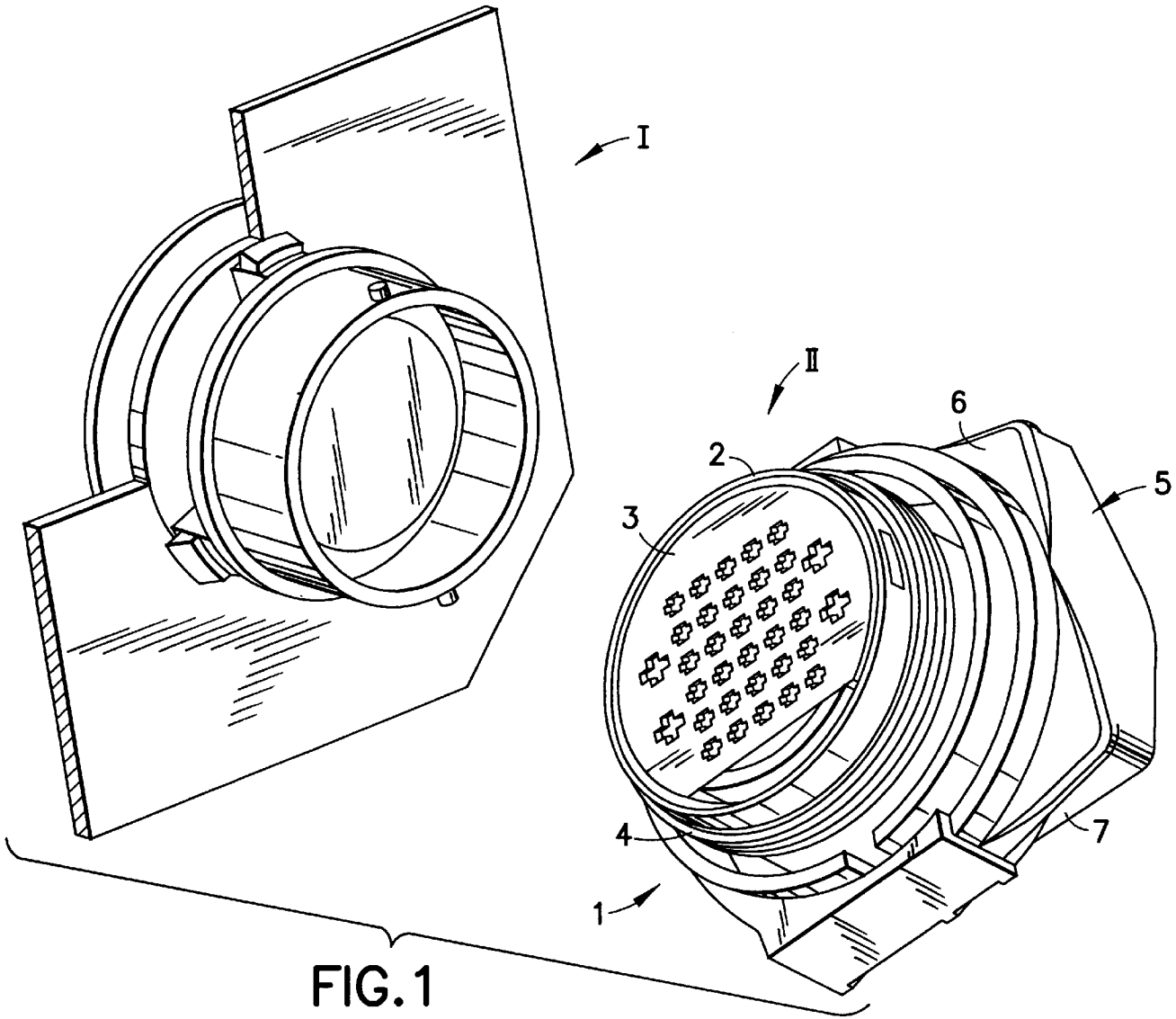
FIG. 1 shows the main parts of a plug connection with a perspective front view of the contact housing and plug housing.

The electrical plug connection shown in FIG. 1 is designed as a pre-cabling for the transmission of motor vehicles and consists of a plug part I fixed in a wall opening of a vehicle part and a contact part II which can be plugged therein and which is constructed according to the invention and will be described in detail hereinafter.

The contact part II comprises a contact housing 1 with an annular front part 2 in which there is incorporated a disc-shaped contact insert 3 and a profiled sealing ring 4 is snapped on the outside thereof. A locking device for securing the contact housing 1 in the plug housing of the plug part I is constructed as a slide 5 in the form of a yoke with two limbs 6, 7. A C-shaped yoke 9 is formed on the substantially square back part 8 of the slide 5, and its arms 10, 11 extend over and parallel to the two limbs 6, 7 and each has at its flat inside a guide groove 12, the arms 10, 11 being guided transversely of the plug axis in two parallel guides 42, 43 formed on the contact housing 1.

Figure 2:
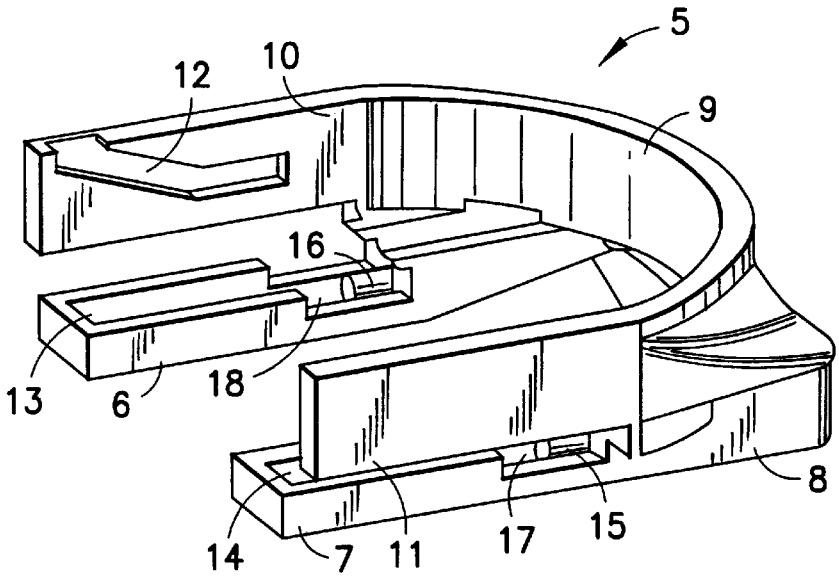
FIG. 2 shows a slide in the form of a yoke in perspective.
Figure 3:
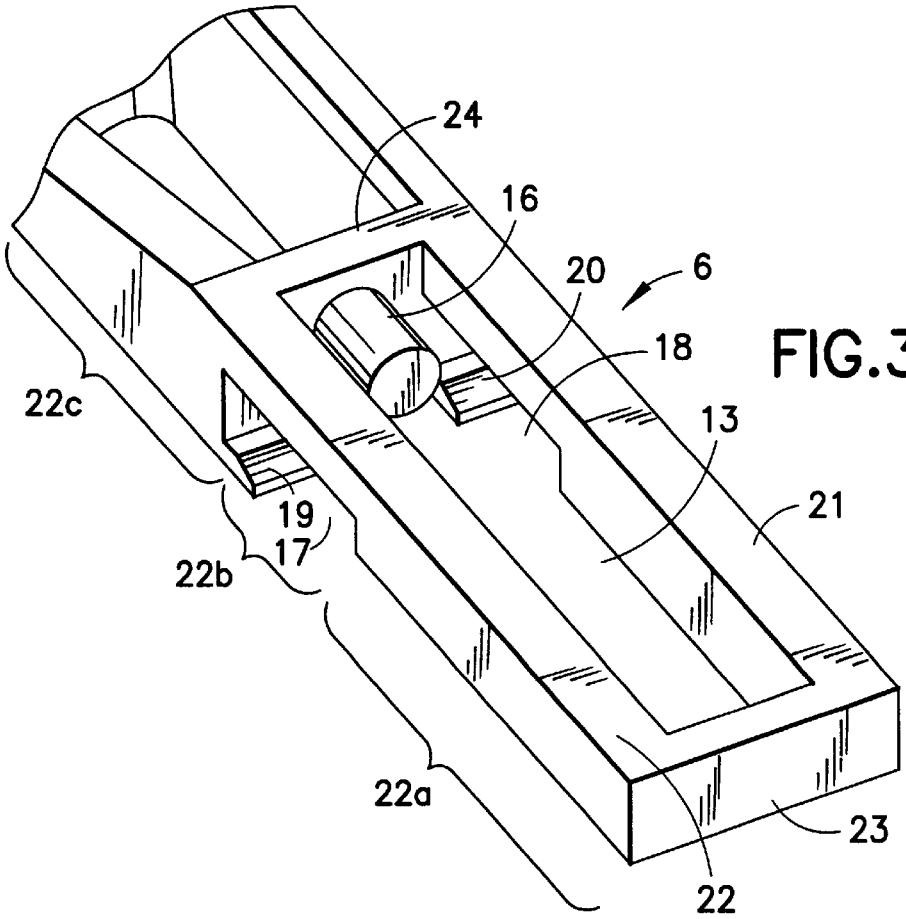
FIG. 3 is a perspective view of one limb of the slide of FIG. 2 without a carriage.

As will be seen particularly from FIGS. 2 and 3, each limb 6, 7 has two side walls 21, 22 which extend in parallel in the sliding direction and which together with a partition 23 formed on one side each define an elongate recess 13, 14. An axial stud 15, 16 is formed on the inner end wall 24 of each recess 13, 14 and apertures 17, 18 are provided on both sides in the two side walls 21, 22 into each of which there projects on one side a tongue 19, 20 with an oblique ramp surface.

Figure 4A:
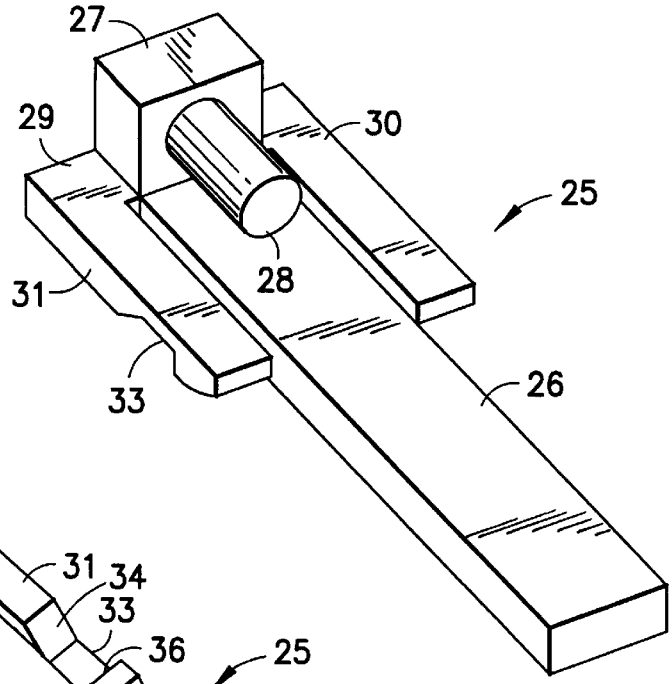
FIGS. 4*a* and 4*b* show the slide carriage in perspective in top and bottom plan view respectively.
Figure 4B:
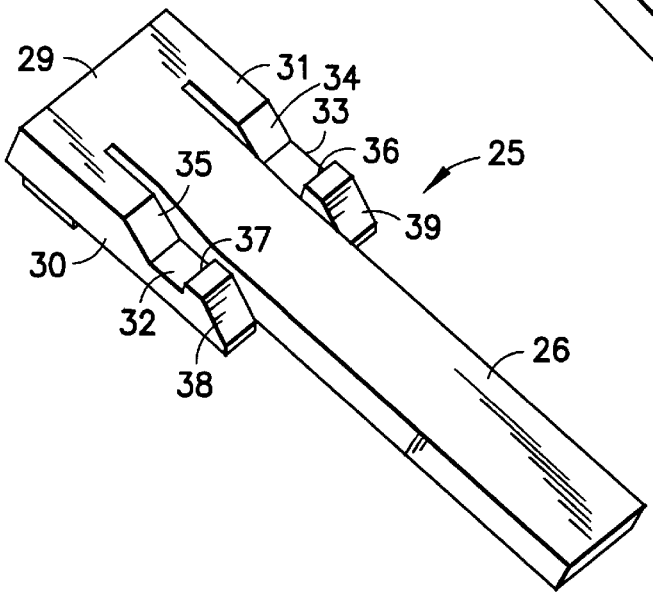

Each limb 6, 7 of the slide 5 has an associated carriage 25 shown in FIGS. 4*a* and 4*b*. Each carriage 25 has a substantially rectangular elongate baseplate 26, at one end of which there is integrally formed a support plate 27 perpendicular thereto with a pin 28 extending parallel to the baseplate 26. Parallel to both sides of the baseplate 26 there extend webs 30, 31 in the form of tongues which at the ends are integrally connected to the widened end part 29 of the baseplate 26. Formed in each web 30, 31 is a downwardly open cut-out 32, 33, which is defined at one end by an oblique surface 34, 35 and at the other end by a vertical surface 36, 37. The undersides of the baseplate 26 and of the webs 30, 31 lie in one plane.

Figure 5:
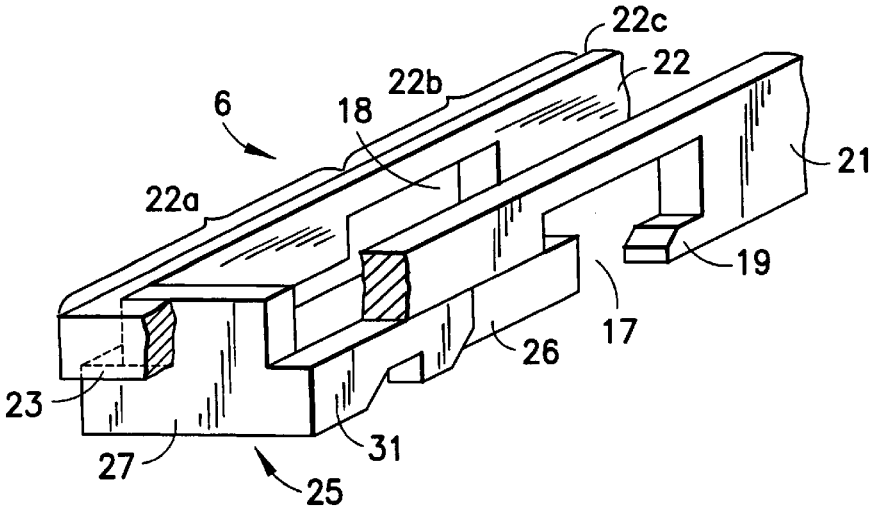
FIG. 5 is an enlarged-scale perspective view of the partially sectioned limb with the carriage.

FIG. 5 shows one limb 6 of the slide 5 of FIG. 3 together with a built-in carriage 25 according to FIG. 4*a*, 4*b* without an expanding spring. The carriage 25 is an end position in which its support plate 27 bears against the end partition 23 of the limb 6. The width of the carriage 25 corresponds to the width of the limb 6 so that the two tongue-shaped elastically deformable webs 30, 31 are situated opposite the tongues 19, 20 projecting into the apertures 17, 18. The top of the support plate 27 is in line with the upper surfaces of the walls 21 to 24 of the limb 6. The height of the webs 30, 31 of the carriage 25 is smaller than the height of the support plate 27, so that the front zone 21*a*, 22*a* of the side walls 21, 22 can slide on the upper side of the webs 30, 31. The width of the side walls 21, 22 corresponds to the width of the webs 30, 31. The middle zone 21*b*, 22*b* of the side walls 21, 22 has the already mentioned apertures 17, 18 to receive the webs 30, 31 so that the height of the middle zone 21*b*, 22*b* turns out smaller than the height of the front zone 21*a*, 22*a*. This middle zone 21*b*, 22*b* is continued by the rear zone 21*c*, 22*c* of the side walls 21, 22 so that the undersides of the webs 30, 31, of the tongues 19, 20 and of the rear zone 21*c*, 22*c* of the side walls 21, 22 are in one plane.

Figure 6A:
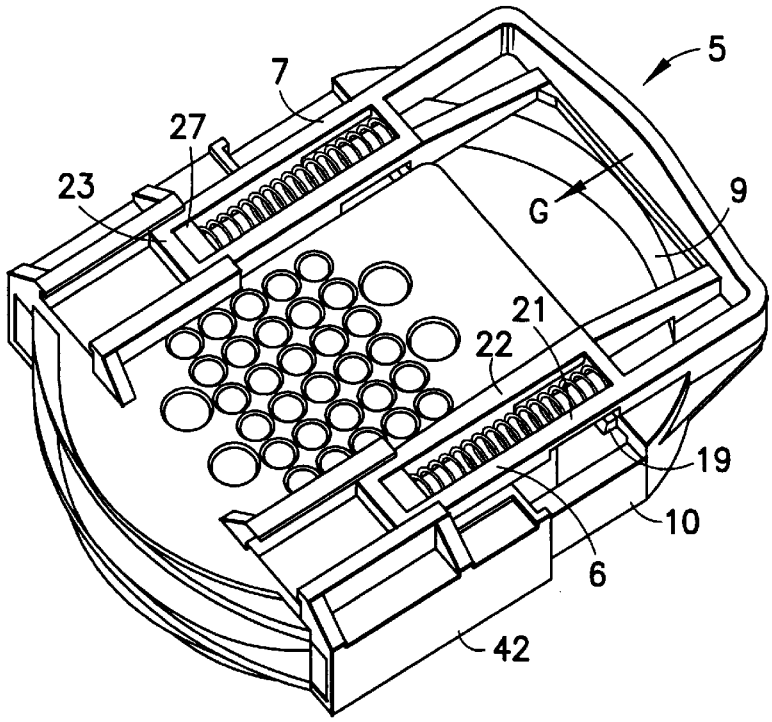
FIGS. 6*a*–6*c* show the contact housing with the slide in different positions and FIGS. 7*a*–7*d* show the mode of operation of the exemplified embodiment of a tongue.
Figure 6B:
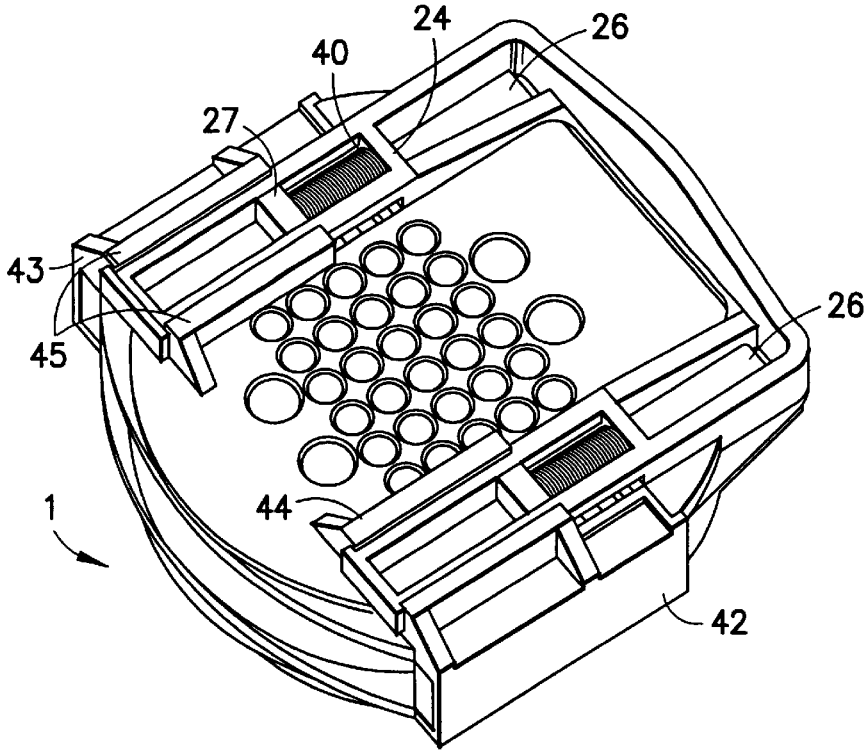
Figure 6C:
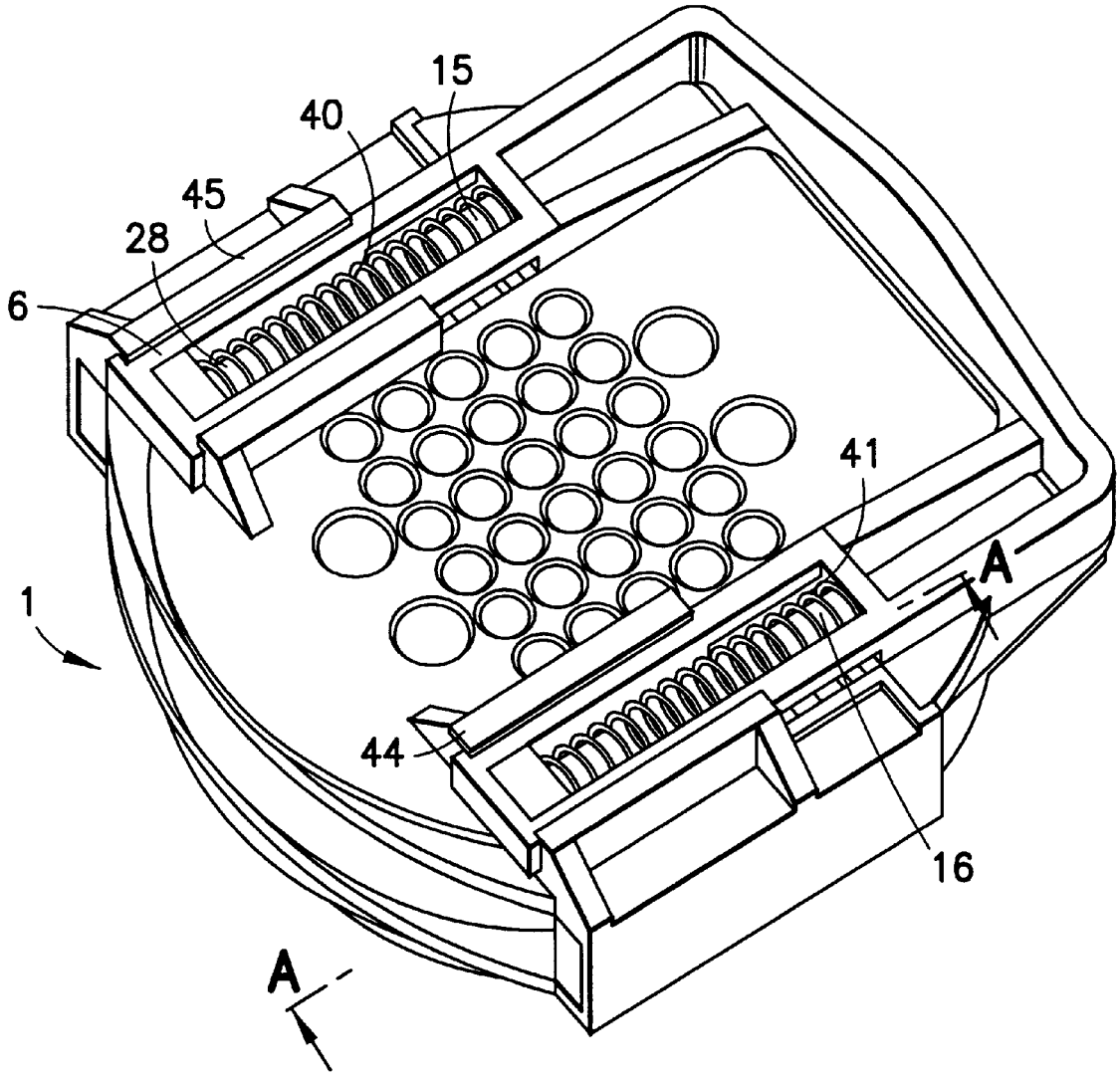

FIGS. 6*a* to 6*c* show the back of the contact housing 1 with a slide 5 in different positions, two built-in carriages 25 and two expanding springs 40, 41 each disposed in a recess 13, 14 in the limbs 6, 7 and clamped between the pin 28 and the axial studs 15, 16. As will be clear particularly from FIGS. 7*a* to 7*d*, which illustrate a section on the line A—A included by way of example in FIG. 6*c*, the upper side of the side walls 21, 22 of the limbs 6, 7 are guided by guide rails 44, 45 formed integrally on the contact housing 1.

It will also be seen that the height of the end wall 24 turns out smaller than the height of the rear zone 21*c* of the side wall 21, so that on actuation of the slide 5 the baseplate 26 can slide under this end wall 24. Also formed on the back of the contact housing 1 for each cut-out 32, 33 of the carriage 25 is a matching catch 48 which at one end is defined by an oblique surface 49 and at the other end by a vertical surface 50.

The co-operation of the slide 5 according to FIGS. 2 and 3, of the carriage 25 according to FIGS. 4*a*, 4*b*, and of the contact housing II according to FIG. 1, will now be described with reference to FIGS. 6 and 7.

Figure 7A:
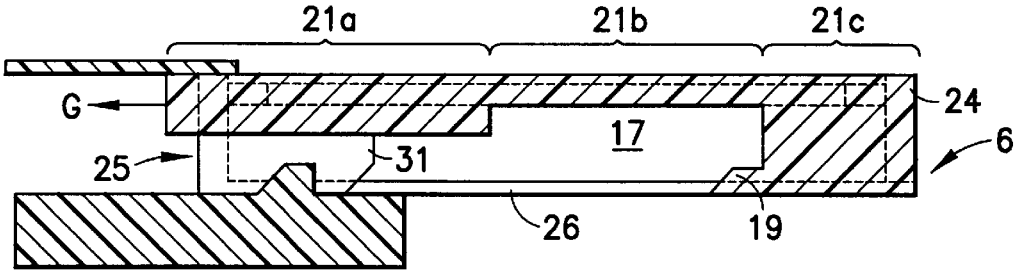

FIG. 6*a* shows the slide 5 in the open position as the fitter receives the contact housing I before insertion, while FIG. 7*a* shows the corresponding sectional drawing to FIG. 6*a*. In this open position, the support plate 27 abuts the partition 23. The catch 48 of the contact housing 1 is situated in the cut-out 33 of the web 31. The underside of the web 31 rests on the back of the contact housing 1. The distance between the support plate 27 and the end plate 24 is at the maximum in this state of the slide so that the expanding spring 41 situated therebetween is relieved of stress.

Figure 7B:
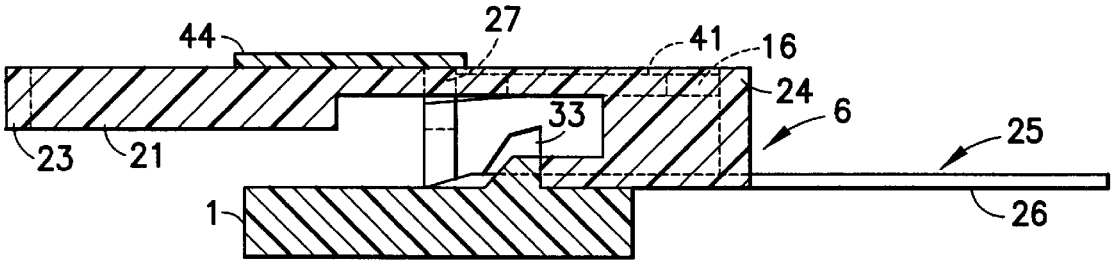

The matching plug part I (see FIG. 1) is now plugged on to the front of the contact part II. To lock the plug connection, the fitter must press the slide 5 in the direction of arrow G. In these circumstances the upper side of the side walls 21, 22 is guided by the guide rails 44, 45. As will be clear particularly from FIG. 7*a*, the underside of the front zone 21*a* of the side wall 21 slides on the upper side of the web 31. The entire carriage 25 does not change its position, since the catch 48 holds the web 31 fast. The end wall 24 slides over the baseplate 26. The distance between the support plate 27 and end plate 24 is reduced, i.e. the expansion spring 41 is stressed. The catch elements (not shown) of the slide 5 and of the contact housing 1 do not interlock until the slide 5 is completely pushed into the contact housing 1, as shown in FIG. 6*b*, FIG. 7*b* being the corresponding sectional drawing. The distance between the support plate 27 and the end plate 24 is then the smallest. Consequently the force acting on the end wall 24 and produced by the expanding spring 41 is at maximum. If the catch elements (not shown) are so designed as to withstand this force, the slide 5 remains in the closed position, but with the disadvantage that the expanding spring 41 is constantly stressed. To obviate this unwanted effect, the springs 41, 40 must be relieved of stress.

As will be seen particularly from FIG. 7*a*, for this purpose the tongue 19 projects into the aperture. As soon as the catch elements (not shown) engage, the oblique ramp surface of the tongue 19 passes beneath the web 31 (see FIG. 7*b*). The ramp 38 of the web 31 facilitates the insertion of the tongue 19 thereunder. As a result, the web 31 is lifted over the catch 48 into the aperture 17 and is slightly elastically deformed. Since the slide 5 is connected to the contact housing 1 because of the catch elements (not shown), the expanding spring 41 can only be relieved of stress by the carriage 25 moving together with the webs 30, 31 in the direction of the partition 23. After overcoming the catch 48 the web 31 again comes on to the back of the contact housing 1 because of its elastic deformation (see FIG. 7*c*).

It is also feasible for the force directed towards the back of the contact housing 1 to be generated by rigid webs 30, 31 and a flexible baseplate 26. In that case (not shown), the support plate 27 would also be lifted and the webs 30, 31 would not undergo deformation. Instead the baseplate 26 would be elastically deformed.

Figure 7C:
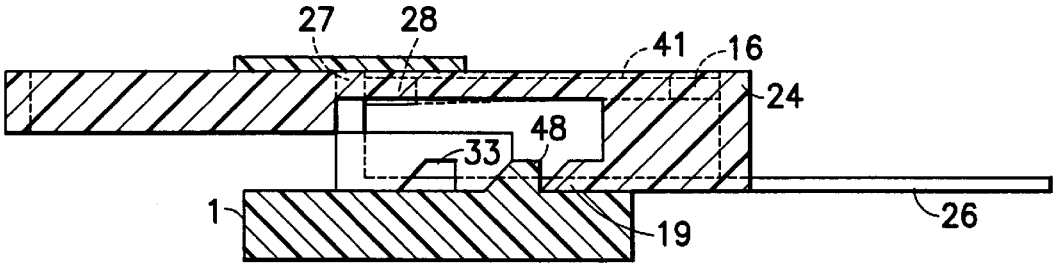
Figure 7D:
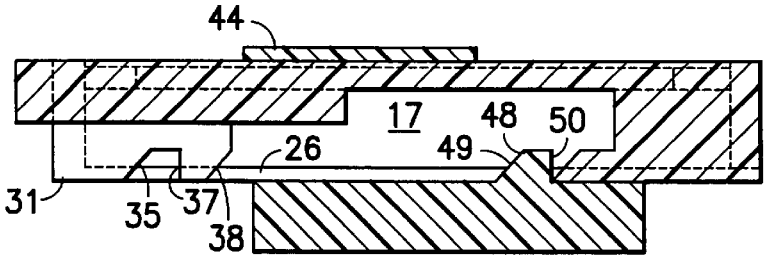

After the webs 30, 31 have reached the back of the contact housing 1, i.e. as shown in FIG. 7*c*, they slide beneath the underside of the front zone 21*a* of the side walls 21 until the support plate 27 meets the partition 23. The distance between the support plate 27 and the end plate 24 is now again at a maximum, i.e. the expanding spring 41 is relieved of stress. This"stress-relieved" closed position is shown both in FIG. 6*c* and in FIG. 7*d*.

It should be noted that FIG. 7*c* shows an intermediate position of FIG. 7*b*, which is the sectional view of FIG. 6*b*, and of 7*d*, which is the sectional view of FIG. 6*c*. None of the FIGS. 6*a* to 6*c* shows the position of FIG. 7*c*.

Of course if the slide 5 is not completely pushed in, i.e., before the catch elements (not shown) can engage, the expanding spring 41 presses the slide 5 back into its open position, since the carriage 25 is connected to the catch 48 as shown in FIG. 7*a*.

It should also be noted that in the"unstressed" closed position the carriage 25 and support plate 27 abut the partition 23, the spring being somewhat prestressed between the pin 27 and the axial stud 16 so that a vibration of the carriage 25 can be effectively suppressed. The clearance between the guide rail 44 and the back of the contact housing 1 is so minimal that there is hardly any vibration of the side walls 21, 22 and of the webs 30, 31.

On the opening of the plug connection, with the slide 5 being pulled out of the contact housing 1, the slide 5 entrains the carriage 25 since the support plate 27 abuts the partition 23. As soon as the ramp 38 comes on to the oblique surface 49, the web 31 is lifted over the catch 48 into the aperture 17. After overcoming the catch 48 it passes into the cut-out 33 as shown in FIGS. 7*a* and 6*a*. The distance between the support plate and the end plate does not change during the opening of the plug connection and is at maximum. The plug connection is thus again prepared for re-locking.

It should be noted that the above-described features of the exemplified embodiments can be combined with one another in any desired manner.

What is claimed:

1. An electrical plug connection comprising:

a plug housing;

a contact housing (1) complementary to the plug housing;

a transverse slide (5) slidably coupled to the contact housing (1) between a closed position and an open position, wherein the transverse slide (5) is adapted to lock the plug housing to the contact housing (1) in the closed position; and at least one movable carriage (25) slidably coupled to the contact housing (1);

wherein at least one spring element (40, 41) is adapted to exert a force between the at least one movable carriage (25) and the transverse slide (5) during closing of the transverse slide (5), and wherein the at least one spring element (40, 41) is further adapted to push the transverse slide (5) to the open position when there is an incomplete closing of the transverse slide (5), and wherein the transverse slide (5) is locked in the closed position only on complete closing of the transverse slide (5).

2. The plug connection according to claim 1, wherein the contact housing (1) has a catch (48), and wherein the transverse slide (5) and the plug housing comprise a pair of co-operating catch elements adapted to lock the plug connection in the closed position, and wherein the movable carriage (25) comprises at least one web (30, 31) forming a connection with the catch (48) wherein on sliding of the transverse slide (5) from the open position toward the closed position, the spring element (40, 41) connected to the carriage (25) at one end is stressed.

3. The plug connection according to claim 2, wherein the transverse slide (5) has at least one tongue (19, 20) adapted to break the connection between the web (30, 31) and the catch (48) at the closed position so that the spring element (40, 41) is unstressed.

4. The plug connection according to claim 3, wherein the catch (48) is formed on the contact housing (1), and wherein the other end of the spring element (40, 41) is connected to the transverse slide (5), and wherein the tongue (19, 20) is formed on the transverse slide (5).

5. The plug connection according to claim 1, wherein the transverse slide (5) comprises at least two limbs (6, 7), and wherein the movable carriage (25) is disposed movably in a recess (13, 14) of the transverse slide (5).

6. The plug connection according to claim 1, wherein the transverse slide (5) comprises at least one axial stud (15, 16) to which one end of the spring element (40, 41) is connected.

7. The plug connection according to claim 2, wherein the movable carriage (25) has a pin (28) for the other end of the spring element (40, 41) and the web (30, 31) has a cut-out (32, 33) matching the catch (48).

8. The plug connection according to claim 12, wherein the catch (48) is formed with an oblique surface (49) on the back of the contact housing (1).

9. The plug connection according to claim 5, wherein the limbs (6, 7) of the transverse slide (5) each have two side walls (21, 22), and wherein the movable carriage (25) is disposed movably between said two side walls (21, 22).

10. The plug connection according to claim 9, wherein the movable carriage (25) has at least one web (30, 31), and wherein the side wall (21, 22) has at least one other aperture (17) which receives the web (30, 31) in the closed position.

* * * * *